US009961986B2

(12) United States Patent
Dieguez

(10) Patent No.: US 9,961,986 B2
(45) Date of Patent: May 8, 2018

(54) SPORTING WEAPON BACKPACK

(71) Applicant: Daniel Robert Dieguez, Deltona, FL (US)

(72) Inventor: Daniel Robert Dieguez, Deltona, FL (US)

( * ) Notice: Subject to any disclaimer, the term of this patent is extended or adjusted under 35 U.S.C. 154(b) by 0 days. days.

(21) Appl. No.: 14/991,933

(22) Filed: Jan. 9, 2016

(65) Prior Publication Data

US 2017/0196343 A1 Jul. 13, 2017

(51) Int. Cl.

| | |
|---|---|
| ***A45F 3/04*** | (2006.01) |
| ***F41B 5/14*** | (2006.01) |
| ***F41C 33/06*** | (2006.01) |

(52) U.S. Cl.

CPC ..... *A45F 3/04* (2013.01); *F41B 5/1457* (2013.01); *F41C 33/06* (2013.01); *A45F 2200/0591* (2013.01)

(58) Field of Classification Search

CPC .. A45F 3/04; A45F 2200/0591; F41B 5/1457; F41C 33/046

(Continued)

(56) References Cited

U.S. PATENT DOCUMENTS

D311,813 S * 11/1990 Oliver ..... D3/216
5,465,887 A * 11/1995 Hudson ..... F41B 5/1457 224/651

(Continued)

*Primary Examiner* — Peter Helvey
(74) *Attorney, Agent, or Firm* — Jason T. Daniel, Esq.; Daniel Law Offices, P.A.

(57) ABSTRACT

The system of the preferred embodiments is a sporting weapon backpack including: two shoulder straps; a folding protective cover attached to the shoulder straps, where the shoulder straps are attached to the exterior surface of the first side of the folding protective cover, where the folding protective cover is sized to protect the majority of a sporting weapon, where the folding protective is constructed from fabric; padding attached to the folding protective cover; at least one bag compartment attached to the exterior surface of the second side of the folding protective cover, where the bag compartment can be selectively closed by at least one of A) a zipper, B) straps and buckles, C) clasps and straps, and D) hook and loop fasteners; at least one temporary fastener attached to the peripheral edge of both sides of the folding protective cover, where the at least one temporary fastener is adapted to temporarily fasten one peripheral edge of the folding protective cover to the other peripheral edge of the folding protective cover; at least one of I) at least one pouch attached near the bottom of the interior surface of at least one side of the folding protective cover, and II) at least one strap, where the at least one of I) at least one pouch and II) at least one strap is adapted to support the sporting weapon, where the sporting weapon may be supported and the at least one temporary fastener may be used to close the folding protective cover over the sporting weapon to securely hold and transport the sporting weapon. The sporting weapon backpack of the preferred embodiments is preferably designed to easily transport and protect a sporting weapon on a user's back, while also providing bag compartments that can be used to store any additional items and gear as with a standard backpack. The system of the preferred embodiments may, however, be used for any suitable purpose.

19 Claims, 5 Drawing Sheets

(58) Field of Classification Search
USPC ..... 224/650
See application file for complete search history.

(56) References Cited

U.S. PATENT DOCUMENTS 5,779,112 A * 7/1998 Krulik ..... A45C 9/00 224/155
5,961,017 A * 10/1999 Mehler ..... A45C 7/009 224/153
5,975,393 A * 11/1999 Bellamy ..... A01K 97/08 206/315.11
6,290,114 B1 * 9/2001 Berberian ..... A45F 3/04 224/637
6,536,638 B1 * 3/2003 Gulmatico, III ..... A45C 7/0077 224/153
6,763,987 B1 * 7/2004 Eberle ..... A45F 3/04 224/637
6,935,495 B1 * 8/2005 Mc Kenzie ..... A45C 13/02 206/315.11
7,568,599 B2 * 8/2009 Hall ..... A45F 3/10 224/250
7,735,701 B2 * 6/2010 Eberle ..... A45F 3/04 224/149
8,047,413 B2 * 11/2011 Arajakis ..... A01M 31/006 206/315.11
8,397,965 B2 * 3/2013 Eberle ..... A45F 3/04 224/637
8,870,045 B1 * 10/2014 Aguirre ..... A45F 3/04 224/581
8,978,949 B2 * 3/2015 Arajakis ..... F41B 5/1457 224/153
9,074,840 B2 * 7/2015 Andersen ..... A45F 3/06
9,138,631 B2 * 9/2015 Scholl ..... A45F 3/14
9,289,049 B2 * 3/2016 Kienel ..... A45F 3/04
D763,567 S * 8/2016 Robert ..... D3/217
9,415,294 B2 * 8/2016 Pino ..... A63C 17/002
2004/0173655 A1 * 9/2004 Markson ..... A45F 3/047 224/638
2005/0000995 A1 * 1/2005 Eberle ..... A45F 3/04 224/637
2007/0131728 A1 * 6/2007 Arajakis ..... A01M 31/006 224/257
2007/0145092 A1 * 6/2007 Eberle ..... A45F 3/04 224/650
2009/0206118 A1 * 8/2009 Sabbah ..... A45C 13/02 224/652
2010/0025446 A1 * 2/2010 Eberle ..... A45F 3/04 224/652
2012/0043358 A1 * 2/2012 Kelly ..... A01K 97/06 224/148.2

* cited by examiner

SPORTING WEAPON BACKPACK

DESCRIPTION OF THE PREFERRED EMBODIMENTS

The following description of the preferred embodiments of the invention is intended to enable someone skilled in the prior art to make and use this invention, but is not intended to limit the invention to these preferred embodiments.

1. First Preferred Embodiment

Figure 1:
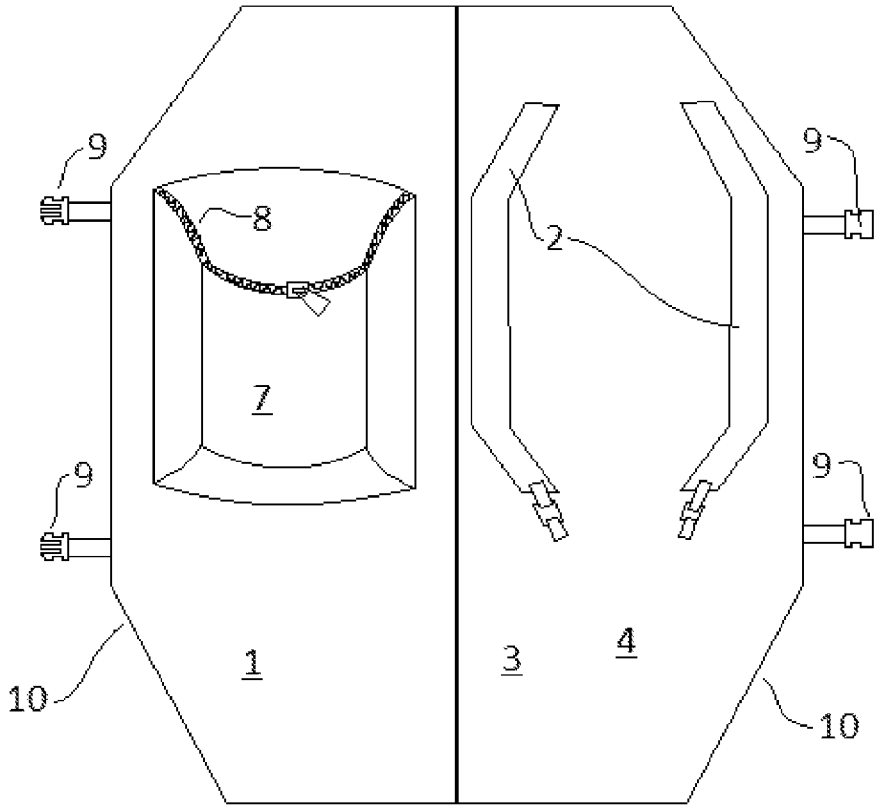
FIG. 1 is a schematic representation of a variation of the system of the preferred embodiments, where the exterior of the folding protective cover is shown unfolded flat.

As shown in FIG. 1, the system of the preferred embodiments is a sporting weapon 12 backpack 1 including: two shoulder straps 2; a folding protective cover 3 attached to the shoulder straps 2, where the shoulder straps 2 are attached to the exterior surface 4 of the first side of the folding protective cover 3, where the folding protective cover 3 is sized to protect the majority of a sporting weapon 12, where the folding protective is constructed from fabric; padding 6 attached to the folding protective cover 3; at least one bag compartment 7 attached to the exterior surface 4 of the second side of the folding protective cover 3, where the bag compartment 7 can be selectively closed by at least one of A) a zipper 8, B) straps and buckles, C) clasps and straps, and D) hook and loop fasteners 9; at least one temporary fastener 9 attached to the peripheral edge 10 of both sides of the folding protective cover 3, where the at least one temporary fastener 9 is adapted to temporarily fasten one peripheral edge 10 of the folding protective cover 3 to the other peripheral edge 10 of the folding protective cover 3; at least one of I) at least one pouch 11 attached near the bottom of the interior surface 5 of at least one side of the folding protective cover 3, and II) at least one strap, where the at least one of I) at least one pouch 11 and II) at least one strap is adapted to support the sporting weapon 12, where the sporting weapon 12 may be supported and the at least one temporary fastener 9 may be used to close the folding protective cover 3 over the sporting weapon 12 to securely hold and transport the sporting weapon 12. The sporting weapon 12 backpack 1 of the preferred embodiments is preferably designed to easily transport and protect a sporting weapon 12 on a user's back, while also providing bag compartment 7*s* that can be used to store any additional items and gear as with a standard backpack. The system of the preferred embodiments may, however, be used for any suitable purpose.

Figure 2:
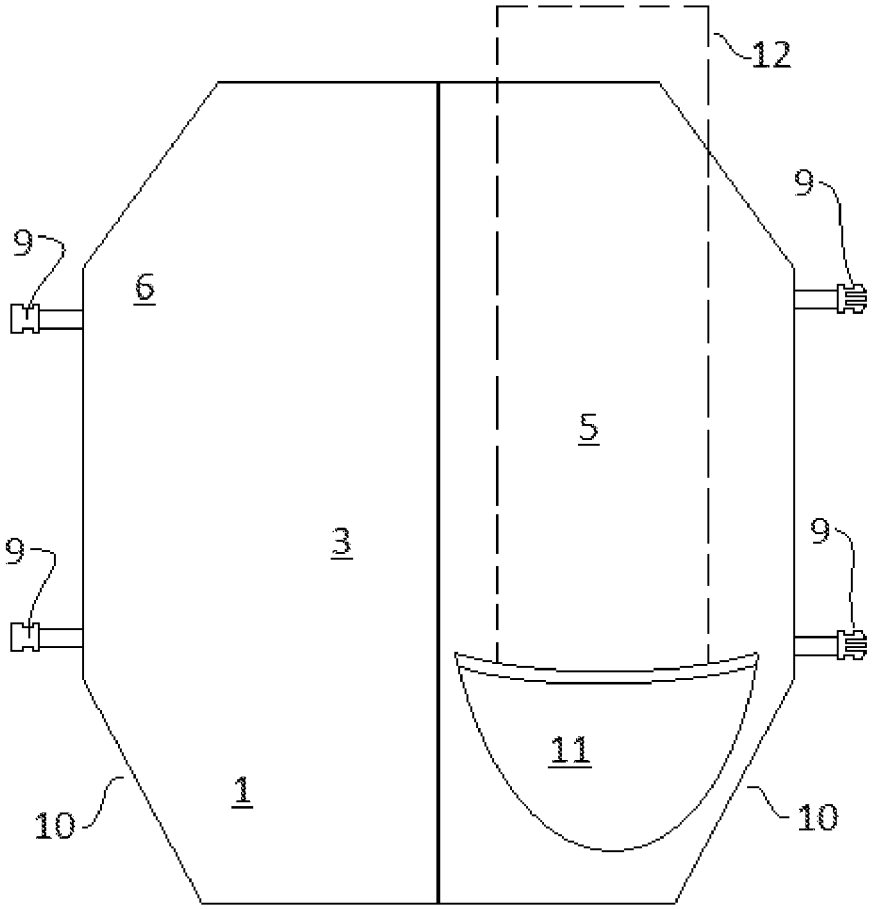
FIG. 2 is a schematic representation of a variation of the system of the preferred embodiments, where the interior of the folding protective cover is shown unfolded flat, with a sporting weapon supported by the pouch.
Figure 3:
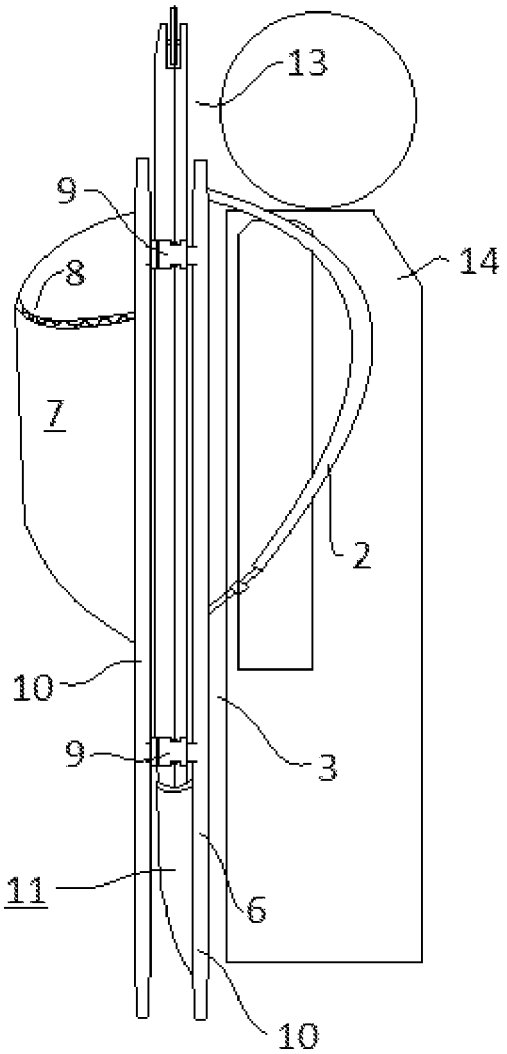
FIG. 3 is a schematic representation of a variation of the system of the preferred embodiments, shown from the side on a user's back with a bow in the closed folding protective cover.

As shown in FIG. 2, the at least one temporary fastener 9 is preferably at least one of a I) a zipper 8, II) straps and buckles, III) clasps and straps, IV) snap buttons, and V) a hook and loop fastener 9. The at least one temporary fastener 9 is preferably attached at least one of to and near the periphery of the folding protective cover 3, and the at least one temporary fastener 9 is designed to fasten the two sides of the folding protective cover 3 together in a closed and folder position surrounding a sporting weapon 12. This allows the sporting weapon 12 to be securely held in a supported and protected position, as shown in FIG. 3. There may, however, be any suitable manner for closing the folding protective device and keeping it closed while enveloping at least part of a sporting weapon 12.

As shown in FIGS. 2 and 3, there is preferably padding 6 attached to the sides of the folding protective cover 3. The padding 6 preferably protects the sporting weapon 12, and makes it more comfortable for the user 14 to transport the sporting weapon 12 while the sporting weapon 12 backpack 1 is worn on the user's back. In a preferred variation, the two sides of the folding protective cover 3 comprise two layers of fabric with padding 6 placed in between the two layers of fabric. In a preferred variation of this variation, the two layers of fabric are sewn together around the padding 6. In a preferred variation of this variation, the padding 6 is foam. There may, however, be any suitable type of padding 6 used and it may be attached in any suitable manner.

As shown in FIG. 2, the pouch 11 preferably supports at least the bottom of the sporting weapon 12. This allows the sporting weapon 12 to be securely held in between the two folded sides of the folding protective cover 3, while being supported from vertical movement by the pouch 11. In another preferred variation, instead of a pouch 11 the sporting weapon 12 backpack 1 includes at least one strap attached to the interior surface 5 of the folding protective cover 3, and the at least one strap is designed to securely hold the sporting weapon 12 in the folding protected cover and to support the sporting weapon 12. There may, however, be any suitable method for securing and supporting the sporting weapon 12 in the folding protective cover 3.

Figure 4:
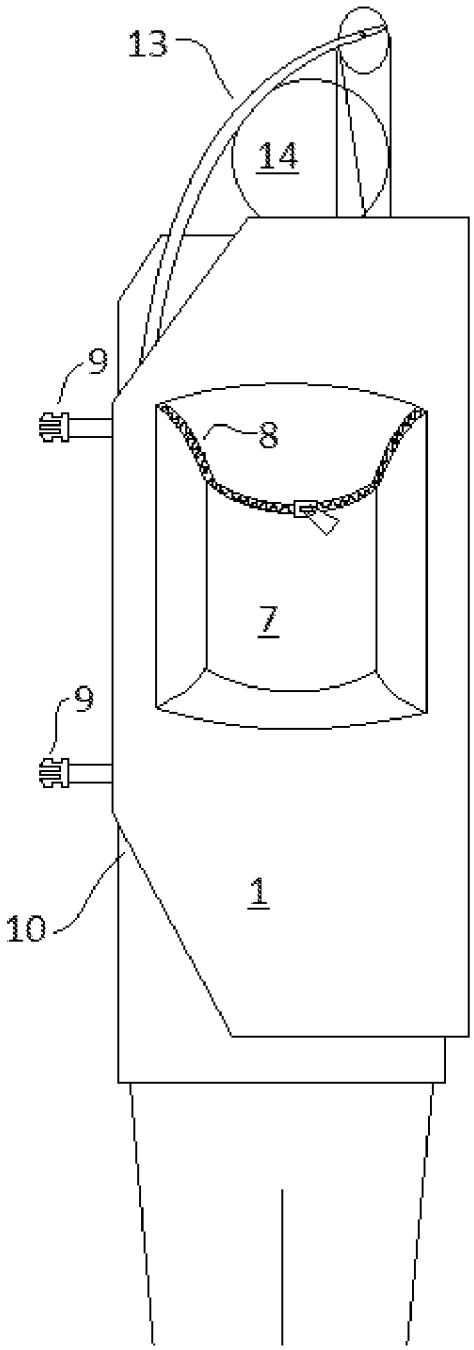
FIG. 4 is a schematic representation of a variation of the system of the preferred embodiments, shown from the rear on a user's back with a bow in the sporting weapon backpack.
Figure 5:
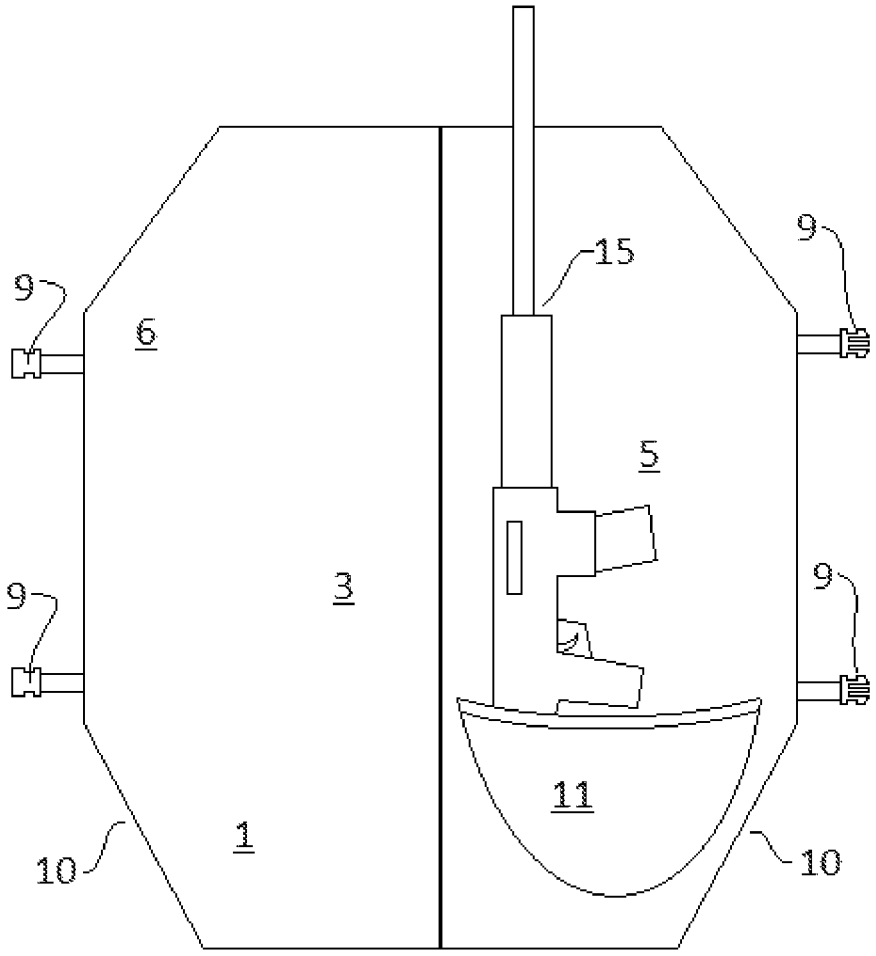
FIG. 5 is a schematic representation of a variation of the system of the preferred embodiments, where the interior of the folding protective cover is shown unfolded flat, with a rifle supported by the pouch.

As shown in FIGS. 3 and 4, in a preferred variation the sporting weapon 12 is a bow 13. In a preferred variation, the sporting weapon 12 is a compound bow 13. In a preferred variation, the folding protective cover 3 is sized and shaped to envelop and protect at least the lower half of a bow 13. In a variation of this variation, the sporting weapon 12 is a compound bow 13. In a preferred variation, the folding protective cover 3 is sized and shaped to envelop and protect at least the lower half of a compound bow 13. As shown in FIG. 5, in another preferred variation the sporting weapon 12 is a rifle 15. In a preferred variation, the folding protective cover 3 is sized and shaped to envelop and protect at least the lower half of a rifle 15.

As shown in FIGS. 3 and 4, the sporting weapon 12 backpack 1 is designed to support and protect the sporting weapon 12 while the sporting weapon 12 backpack 1 is worn on a user's back and supported by the user 14 wearing the shoulder straps 2. In this variation, the at least one of I) a pouch 11, and II) at least one strap supports the sporting weapon 12 and prevents it from sliding out of the folding protective cover 3.

In a preferred variation, there are at least two bag compartment 7*s*. Preferably the sporting weapon 12 backpack 1 of the first preferred embodiments fixes the issues with the prior art where carrying at least one of items and gear alongside a sporting weapon 12 is difficult, even more difficult if the user 14 attempts to carry a backpack in addition to a sporting weapon 12, where there is generally not a good way to transport both at once. There may however, be any suitable number of bag compartment 7*s*. The system of the preferred embodiments may, however, provide any suitable benefits.

In a preferred variation, the fabric is at least one of A) suitable for use in outdoor conditions and weather, and B) has been treated to make it suitable for use in outdoor connections and weather. The system of the preferred embodiments may, however, be made of any suitable materials.

As a person skilled in the art will recognize from the previous detailed description and from the figures and claims, modifications and changes can be made to the preferred embodiments of the invention without departing from the scope of this invention defined in the following claims.

I claim:

1. A sporting weapon backpack comprising:

two shoulder straps;

a folding protective cover attached to the shoulder straps, wherein the shoulder straps are attached to an exterior surface of a first side of the folding protective cover, wherein the folding protective cover is sized to protect the majority of a sporting weapon, wherein the folding protective is constructed from fabric;

padding attached to the folding protective cover;

at least one bag compartment attached to the exterior surface of a second side of the folding protective cover, wherein the bag compartment can be selectively closed by at least one of A) a zipper, B) straps and buckles, C) clasps and straps, and D) hook and loop fasteners;

at least one temporary fastener attached to a peripheral edge of both sides of the folding protective cover, wherein the at least one temporary fastener is adapted to temporarily fasten one peripheral edge of the folding protective cover to the other peripheral edge of the folding protective cover;

at least one pouch attached near the bottom of the interior surface of at least one side of the folding protective cover, wherein the at least one pouch is adapted to support at least a portion of the sporting weapon, wherein the at least one temporary fastener is adapted to close the folding protective cover over the at least one pouch to securely hold and transport the sporting weapon, wherein the at least one pouch comprises an openings and a bottom portion coupled with the interior surface of at least one side of the folding protective cover, wherein the bottom portion is adapted to support at least a portion the sporting weapon.

2. The sporting weapon backpack of claim 1, wherein the at least one temporary fastener comprises at least one of I) a zipper, II) straps and buckles, III) clasps and straps, IV) snap buttons, and V) a hook and loop fastener.

3. The sporting weapon backpack of claim 1, wherein the padding is enclosed between two layers of fabric, wherein one layer of fabric forms the interior surface of the folding protective cover, wherein the second layer of fabric forms the exterior surface of the folding protective cover.

4. The sporting weapon backpack of claim 3, wherein the padding comprises foam.

5. The sporting weapon backpack of claim 2, wherein the padding is enclosed between two layers of fabric, wherein one layer of fabric forms the interior surface of the folding protective cover, wherein the second layer of fabric forms the exterior surface of the folding protective cover.

6. The sporting weapon backpack of claim 5, wherein the padding comprises foam.

7. The sporting weapon backpack of claim 1, wherein the weapon is a bow.

8. The sporting weapon backpack of claim 7, wherein the folding protective cover is adapted to support and provide protective cover to at least the bottom half of the bow.

9. The sporting weapon backpack of claim 4, wherein the weapon is a bow.

10. The sporting weapon backpack of claim 9, wherein the folding protective cover is adapted to support and provide protective cover to at least the bottom half of the bow.

11. The sporting weapon backpack of claim 1, wherein the weapon is a rifle.

12. The sporting weapon backpack of claim 11, wherein the folding protective cover is adapted to support and provide protective cover to at least the bottom half of the rifle.

13. The sporting weapon backpack of claim 4, wherein the weapon is a rifle.

14. The sporting weapon backpack of claim 13, wherein the folding protective cover is adapted to support and provide protective cover to at least the bottom half of the rifle.

15. The sporting weapon backpack of claim 8, wherein the sporting weapon backpack is adapted to allow a user to comfortably carry the bow on the user's back, wherein the bow is supported by at least one of the I) at least one pouch, and II) at least one strap, wherein the sporting weapon backpack is secured to the user's back and supported by the two shoulder straps.

16. The sporting weapon backpack of claim 10, wherein the sporting weapon backpack is adapted to allow a user to comfortably carry the bow on the user's back, wherein the bow is supported by at least one of the I) at least one pouch, and II) at least one strap, wherein the sporting weapon backpack is secured to the user's back and supported by the two shoulder straps.

17. The sporting weapon backpack of claim 12, wherein the sporting weapon backpack is adapted to allow a user to comfortably carry the rifle on the user's back, wherein the rifle is supported by at least one of the I) at least one pouch, and II) at least one strap, wherein the sporting weapon backpack is secured to the user's back and supported by the two shoulder straps.

18. The sporting weapon backpack of claim 14, wherein the sporting weapon backpack is adapted to allow a user to comfortably carry the rifle on the user's back, wherein the rifle is supported by at least one of the I) at least one pouch, and II) at least one strap, wherein the sporting weapon backpack is secured to the user's back and supported by the two shoulder straps.

19. A sporting weapon backpack comprising:

two shoulder straps;

a folding protective cover attached to the shoulder straps, wherein the shoulder straps are attached to an exterior surface of a first side of the folding protective cover, wherein the folding protective cover is sized to protect the majority of a sporting weapon, wherein the folding protective is constructed from fabric;

padding attached to the folding protective cover;

at least one bag compartment attached to the exterior surface of a second side of the folding protective cover, wherein the bag compartment can be selectively closed by at least one of A) a zipper, B) straps and buckles, C) clasps and straps, and D) hook and loop fasteners;

at least one temporary fastener attached to a peripheral edge of both sides of the folding protective cover, wherein the at least one temporary fastener is adapted to temporarily fasten one peripheral edge of the folding protective cover to the other peripheral edge of the folding protective cover;

at least one pouch attached near the bottom of the interior surface of at least one side of the folding protective cover, wherein the at least one pouch is adapted to support the sporting weapon, wherein the at least one temporary fastener is adapted to close the folding protective cover over at least a portion of the sporting weapon disposed within the at least one pouch to securely hold and transport the sporting weapon, wherein the at least one pouch comprises an openings and a bottom portion coupled with the interior surface of at least one side of the folding protective cover, wherein the bottom portion is adapted to support at least a portion the sporting weapon.

* * * * *